US008141309B2

(12) United States Patent
Kubicek

(10) Patent No.: US 8,141,309 B2
(45) Date of Patent: Mar. 27, 2012

(54) ENERGY ABSORPTIVE IMPALEMENT PROTECTIVE COVER APPARATUS

(75) Inventor: Christopher J. Kubicek, St. Louis, MO (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 142 days.

(21) Appl. No.: 12/431,376

(22) Filed: Apr. 28, 2009

(65) Prior Publication Data

US 2009/0288357 A1 Nov. 26, 2009

Related U.S. Application Data

(60) Provisional application No. 61/056,039, filed on May 26, 2008.

(51) Int. Cl.
*E04H 12/00* (2006.01)

(52) U.S. Cl. ..... 52/301; 138/96 R

(58) Field of Classification Search ..... 52/301, 52/300, 633; 248/548, 345, 345.1; 16/42 R, 16/42 T; 138/96 R; 256/66, 65.01, 59, 19; 108/50.02; 312/223.3; D8/386, 349; 215/355, 215/320; 220/802, 307
See application file for complete search history.

(56) References Cited

U.S. PATENT DOCUMENTS

| | | | | |
|---|---|---|---|---|
| 5,381,636 | A | 1/1995 | Kassardjian et al. | |
| 5,435,350 | A | 7/1995 | Bowes | |
| D363,657 | S | 10/1995 | Kassardjian et al. | |
| 5,469,679 | A * | 11/1995 | Burkard et al. | 52/301 |
| 5,523,043 | A | 6/1996 | Kassardjian et al. | |
| 5,568,708 | A | 10/1996 | Kassardjian et al. | |
| 5,687,772 | A | 11/1997 | Underwood | |
| 5,729,941 | A | 3/1998 | Kassardjian et al. | |
| 5,824,253 | A | 10/1998 | Kassardjian et al. | |
| 5,887,394 | A * | 3/1999 | Workman | 52/301 |
| 5,943,836 | A | 8/1999 | Kassardjian | |
| 5,946,871 | A | 9/1999 | Kassardjian et al. | |
| 6,085,478 | A | 7/2000 | Workman | |
| 6,612,082 | B2 * | 9/2003 | Schimmelpfennig et al. | 52/300 |
| 6,857,235 | B2 | 2/2005 | Niday et al. | |
| 7,234,199 | B2 * | 6/2007 | Bushey | 16/42 R |
| 7,398,961 | B2 * | 7/2008 | Froese | 256/65.14 |
| 2004/0200837 | A1 * | 10/2004 | von Spreckelsen et al. | 220/258.1 |
| 2008/0168726 | A1 * | 7/2008 | Yang | 52/301 |

* cited by examiner

*Primary Examiner* — Branon Painter
(74) *Attorney, Agent, or Firm* — Nancy M. Klembus; Ralph H. Dean, Jr.

(57) ABSTRACT

An energy absorptive impalement protection system is utilized in preventing impalement and minimizing injuries due to impact with the end of a concrete reinforcing bar or other similar type of bar. The energy absorptive impalement protection system is comprised of a protective cover apparatus that has a simplified construction comprised of a base that is removably attached to an end of a reinforcing rod, a metal band on the base that surrounds the rod end and reinforces the base against side-to-side movement relative to the rod in response to an impact force, a metal impact plate on the base that absorbs and distributes the force of impact, and a resilient, compressible and stretchable cover on the base that together with the base encloses the band and cover in the apparatus and also absorbs some of the force of impact.

17 Claims, 6 Drawing Sheets

ENERGY ABSORPTIVE IMPALEMENT PROTECTIVE COVER APPARATUS

CROSS-REFERENCE TO RELATED APPLICATIONS

This patent application claims the benefit of provisional patent application Ser. No. 61/056,039, filed on May 26, 2008.

BACKGROUND OF THE INVENTION

1. Field of the Invention

The present invention pertains to an energy absorptive impalement protection system that is utilized in preventing impalement and minimizing injuries due to impact with the end of a concrete reinforcing bar or other similar type of bar. The energy absorptive impalement protection system is comprised of a protective cover apparatus that is designed to meet and surpass Occupational Safety and Health Administration (OSHA) standards for construction worksites.

The protective cover apparatus has a simplified construction that is comprised of a base that is removably attached to an end of a reinforcing bar, a metal band on the base that surrounds the bar end and reinforces the base against side-to-side movement relative to the bar in response to an impact force, a metal impact plate on the base that absorbs and distributes the force of impact, and a resilient, compressible and stretchable cap on the base that together with the base encloses the band and impact plate in the apparatus and also absorbs some of the force of impact. Should a person fall on a bar end covered by the protective cover apparatus of the invention, the apparatus absorbs the initial kinetic energy of the impact while distributing the point of impact over a greater surface area to prevent impalement and minimize injuries.

2. Related Prior Art

Prior art concrete reinforcement bar (rebar) protective covers prevent impalement of a person falling onto an end of a bar by distributing the force of impact over a greater surface area than the surface area of the bar end. This basic functioning of prior art rebar protective covers is required by OSHA standards. However, prior art rebar protective covers do not address the issue of absorbing the energy of impact. They are basically designed to distribute the force of impact over a greater area. Therefore, the kinetic energy of a human body impacting with a rebar protective cover is absorbed by the compression and deformation of the portion of the human body that impacts with the cover. While prior art rebar protective covers may prevent impalement of the portion of the human body impacting the cover, prior art covers still present a high risk for serious injuries, both internal and external, due to the force of impact.

SUMMARY OF THE INVENTION

The energy absorptive impalement protection system of the present invention is designed to overcome the above-described shortcoming of prior art rebar protective covers. In addition, the protective cover apparatus of the invention has a simplified construction that is comprised of four basic component parts that reduces the manufacturing costs of the apparatus. The four basic component parts of the apparatus include a base, a restraining band, an impact member or plate, and a cap.

The base is designed to align with and be removably attached to the projecting end of a reinforcing bar, and to hold the restraining band, impact member, and cap in place relative to the bar end. The base has a tubular length with opposite first and second ends. The first end of the base has an interior bore containing aligning fins that are designed to be removably attachable over the projecting end of the reinforcing bar. As the base extends from its first end toward the second end, the configuration of the base widens. At the base second end, the base is designed to hold the restraining band in position around the base interior bore, to hold the impact plate adjacent the restraining band and over the end of the base interior bore, and to hold the cap over the impact plate. The second end of the base may be square, rectangular, oval, hexagonal, or any other shape. The preferred embodiment is circular. The second end of the base is of a size that provides for an overall apparatus top surface area or impact surface area of at least 16 square inches. In the preferred embodiment, the base is constructed of a plastic material which allows for some movement of the base upon impact while also providing a resistance to the movement and support to the apparatus.

The band in the preferred embodiment is constructed as a metal cylinder. It is assembled into an annular groove in the base second end. This positions the band around the base interior bore and around the end of the rebar to which the base is attached. This positioning of the band on the base provides additional resistance to the side-to-side movement of the base relative to the rebar end in response to a force impacting with the apparatus that is not axially aligned with the rebar end.

The impact member or impact plate is centered above the interior bore of the base, the band surrounding the interior bore, and the bar end inserted into the interior bore. The primary functions of the impact member are to provide a rigid surface opposing the end of the rebar inserted into the apparatus, to deform and absorb some of the force of impact, and to provide a greater surface area to support the cap and receive the force of impact. In the preferred embodiment, the impact member is a circular cup-shaped plate of metal.

The cap is positioned on the opposite side of the impact member from the base and is secured to a perimeter of the base. The connection of the cap with the base completely encloses the restraining band and the impact member within the apparatus. In the preferred embodiment, the cap is constructed of a resilient, compressible and stretchable material that absorbs some of the force of impact with the apparatus and provides a compressible area between the rigid surface of the impact member and the object impacting the apparatus. The cap also functions to distribute the force of impact over the 16 square inches of the base second end. In the preferred embodiment, the cap is constructed of rubber.

Upon an object or person impacting with the protective cover apparatus of the invention, the cap and the cup-shaped configuration of the impact member are initially compressed, absorbing a portion of the kinetic energy of impact. As a result of the compression, the area of the cap begins to expand and the impact plate is deformed from the cup-shaped configuration toward a more planar configuration, thereby providing a greater surface area over which the force of impact is distributed. In this manner, the protective cover apparatus of the invention achieves the desired objectives of absorbing some of the kinetic energy of a human body impacting the apparatus and reducing the potential for serious injury to the body due to the impact.

BRIEF DESCRIPTION OF THE DRAWINGS

Further features of the apparatus of the invention are set forth in the following detailed description of the preferred embodiment of the apparatus and in the drawing figures.

DETAILED DESCRIPTION OF THE PREFERRED EMBODIMENT

Figure 1:
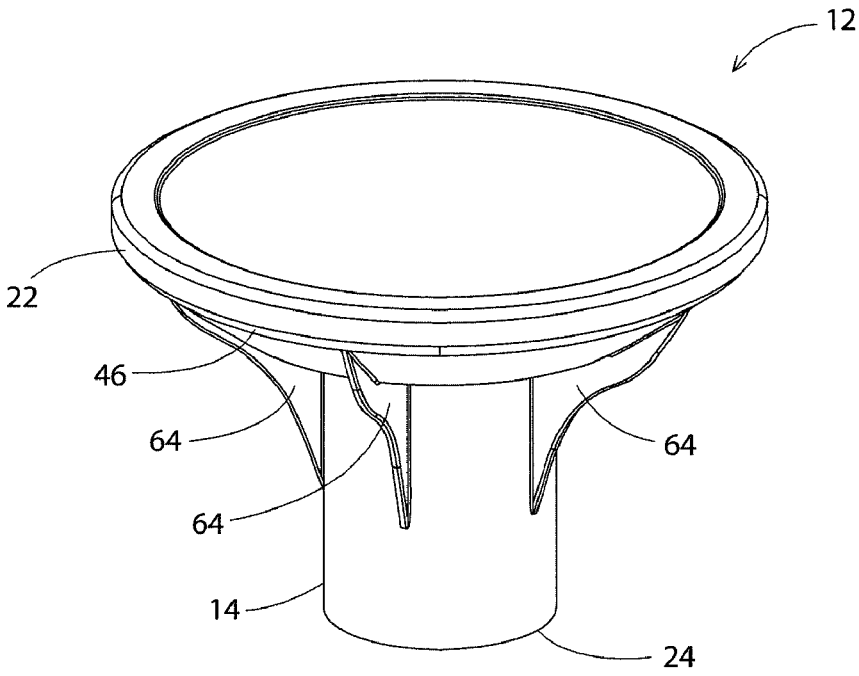
FIG. 1 is a top perspective elevation view of the apparatus of the invention.
Figure 2:
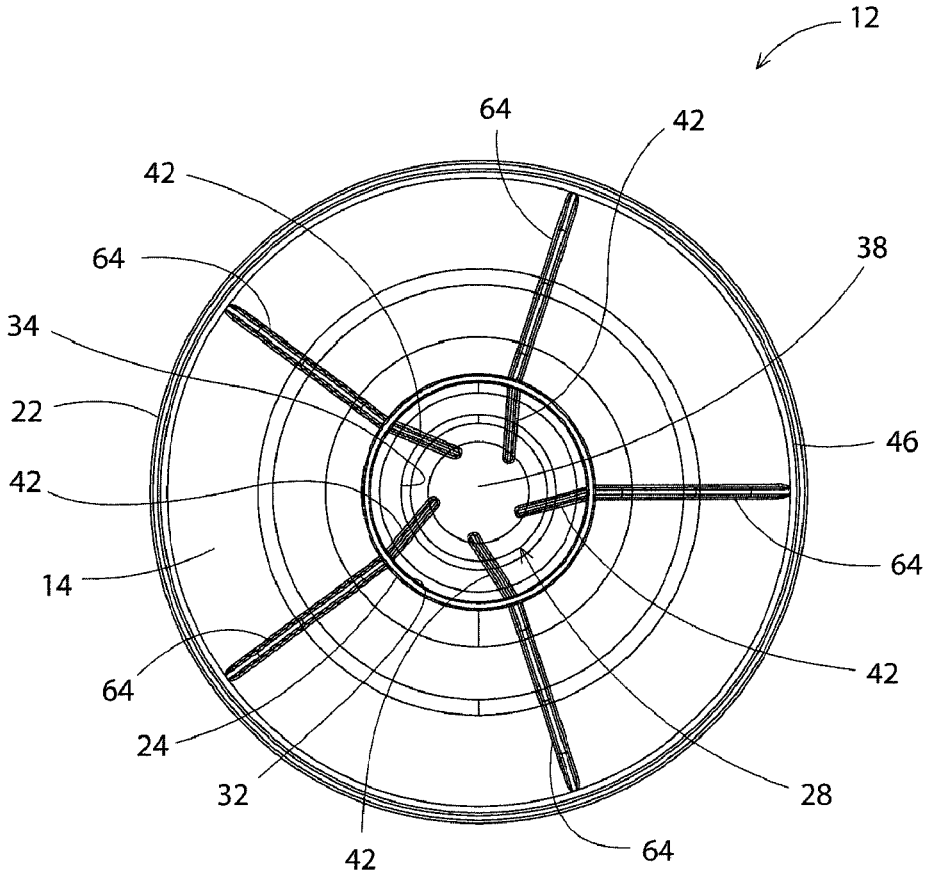
FIG. 2 is a bottom plan view of the apparatus.
Figure 3:
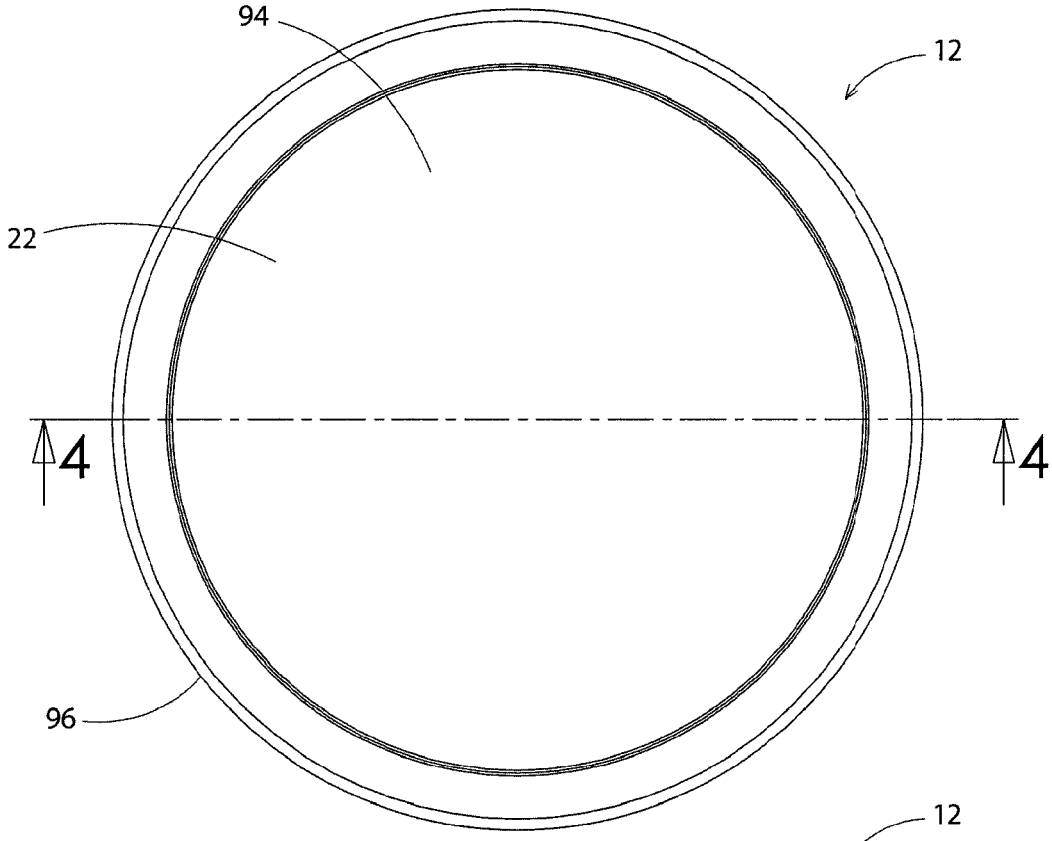
FIG. 3 is a top plan view of the apparatus.
Figure 4:
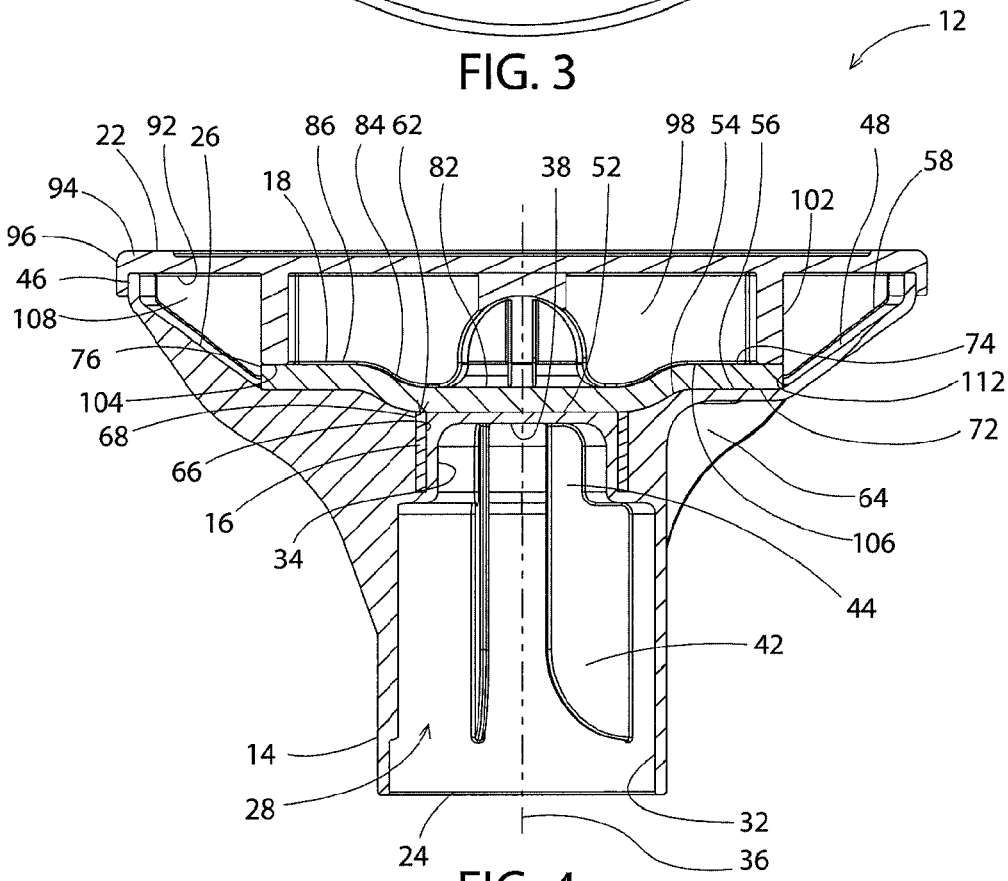
FIG. 4 is a sectioned side elevation view of the apparatus.
Figure 5:
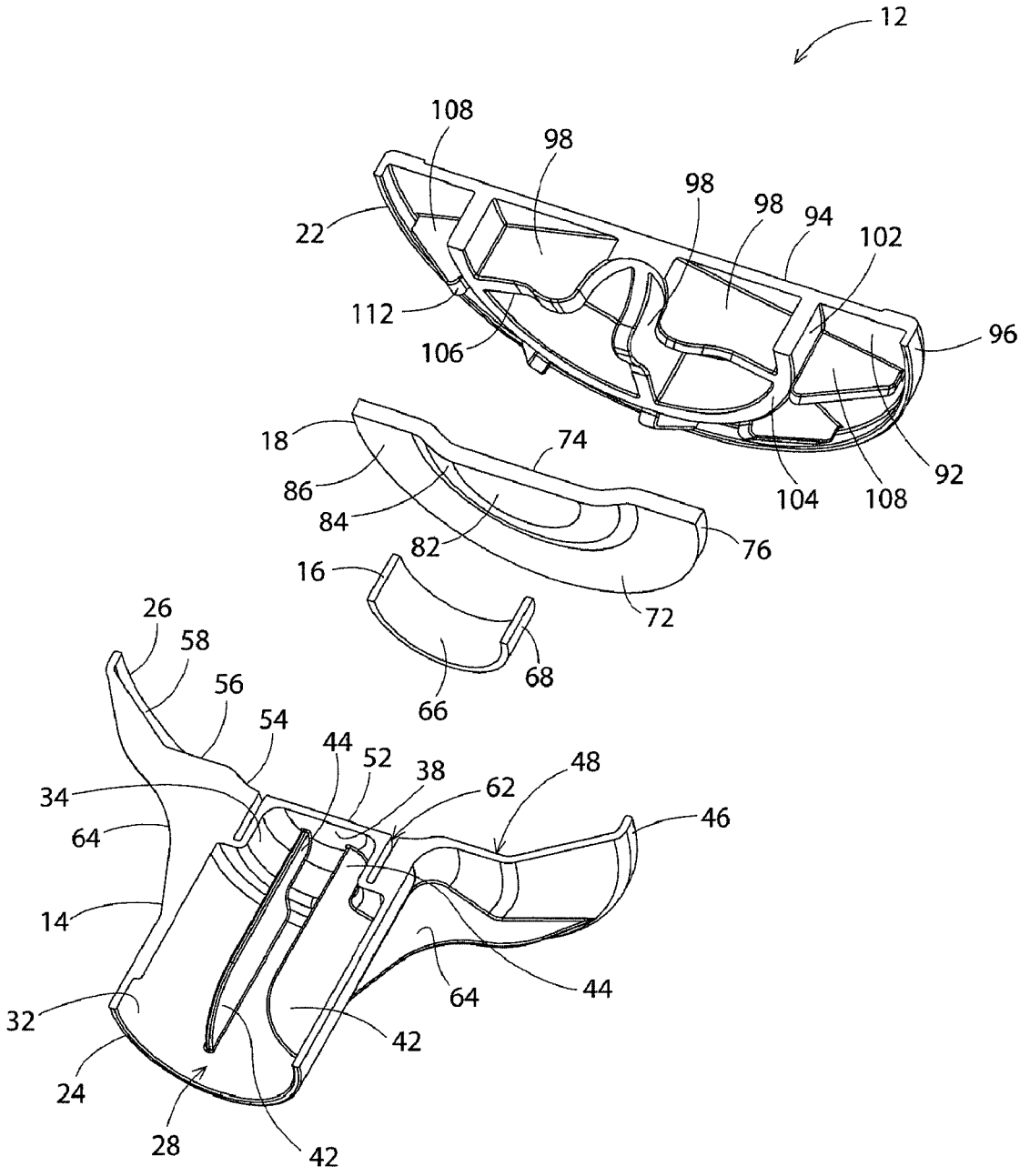
FIG. 5 is a sectioned, bottom perspective view of the component parts of the apparatus shown disassembled.
Figure 6:
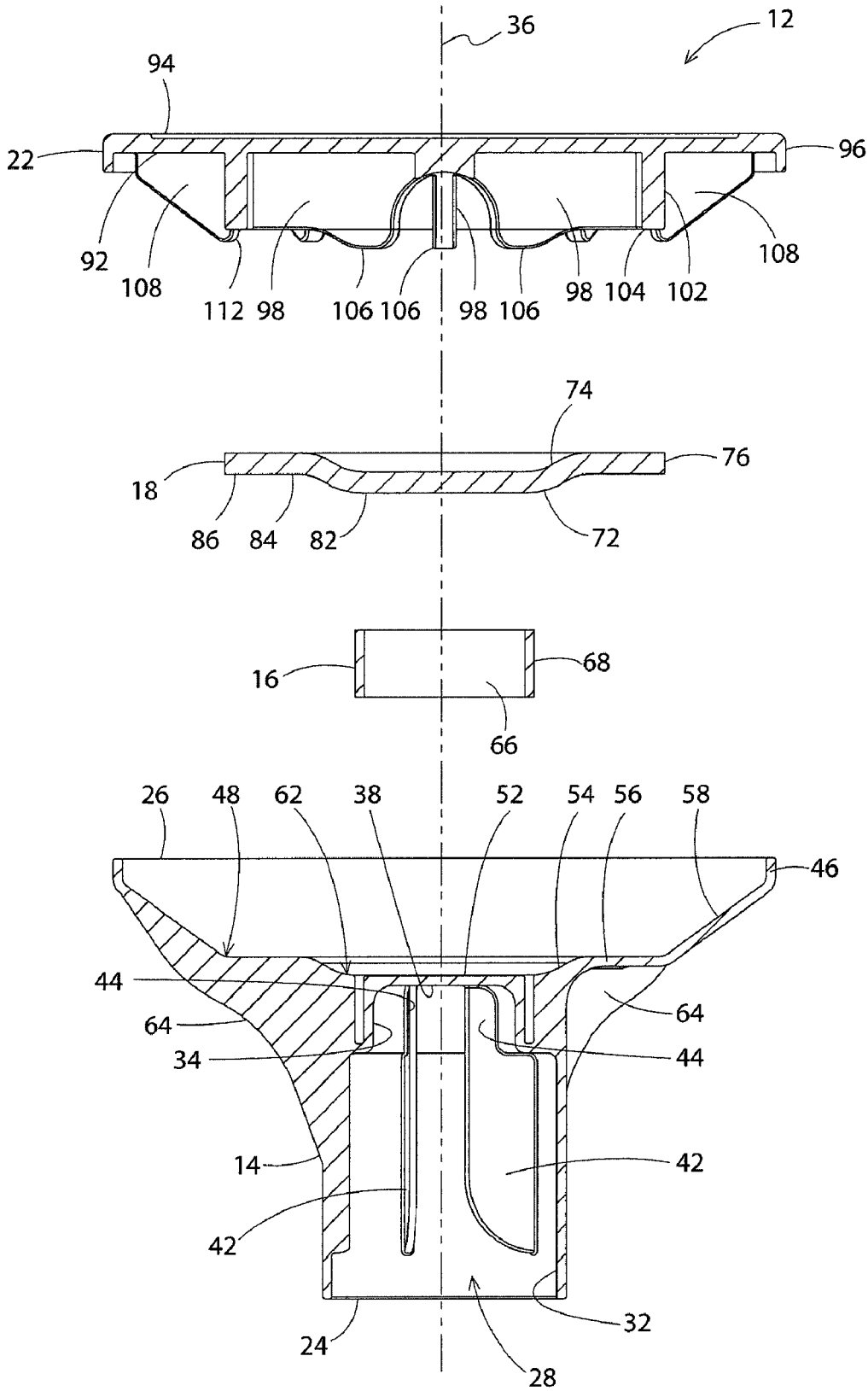
FIG. 6 is a sectioned side elevation view of the component parts of the apparatus shown disassembled.
Figure 7:
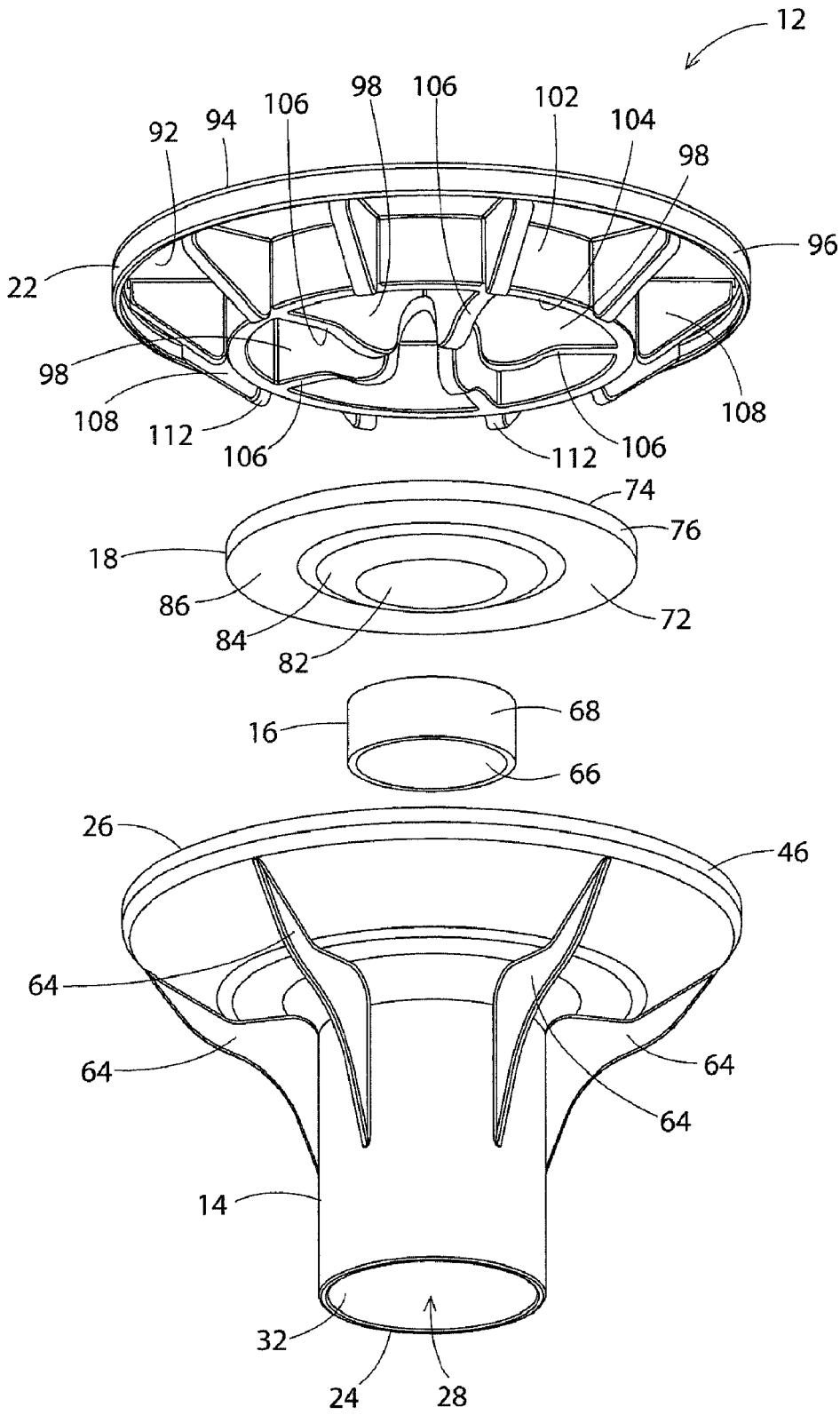
FIG. 7 is a bottom perspective elevation view of the component parts of the apparatus shown disassembled.
Figure 8:
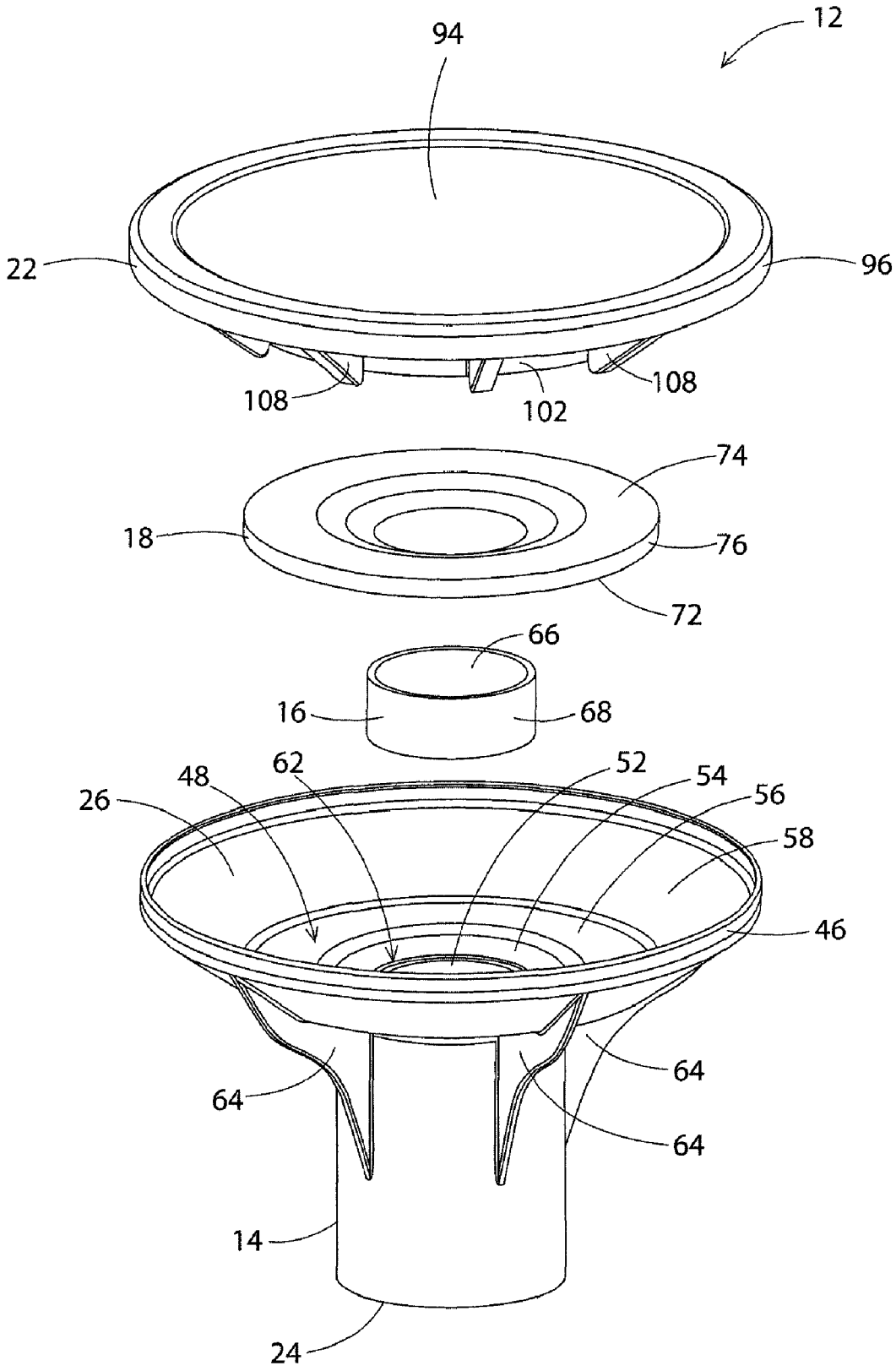
FIG. 8 is a top perspective elevation view of the component parts of the apparatus shown disassembled.

The energy absorptive impalement protective cover apparatus 12 of the present invention is shown in FIG. 1. The protective cover apparatus is primarily intended to function as an impalement protection system employed on the exposed ends of concrete reinforcement bars at construction sites. However, this is only one illustrative example of the use of the protective cover apparatus of the invention. The protective cover may be used as an impalement protection system on the exposed end of most any rod to absorb impact energy from an object impacting with the end of the rod. Other examples of possible uses of the protective cover include on a tent stake or canopy stake protruding from the ground, as a protective cover on a surveyor's stake protruding from the ground, as a protective cover on a concrete form stake, and as a protective cover on the end of any protruding stake or rod that could potentially come into contact with a person or object causing injury to the person or damage to the object. For example, the apparatus could be employed as a protective cover on the end of a stake or rod that could potentially contact a person walking past the stake or rod and scratching the person, or that could potentially contact an object such as an automobile passing by the stake or rod and scratching the automobile.

The protective cover apparatus 12 of the invention has a simplified construction that comprises only four separate component parts. The four basic component parts of the apparatus 12 include a base 14, a restraining band 16, an impact member 18, and a cap 22. This simplified construction reduces the manufacturing costs of the apparatus. Although the apparatus of the invention has a simplified construction and only four component parts, the construction of the apparatus meets all requirements of the Occupational Safety and Health Administration (OSHA).

In the preferred embodiment of the apparatus 12, the base 14 is constructed of a plastic material typically employed in the construction of known impalement protective covers employed on the exposed ends of concrete reinforcement bars (rebar). Other similar types of materials may also be used for the base. As shown in the drawing figures, the base 14 has a general tubular configuration with opposite first 24 and second 26 ends. The base first end 24 is circular, and the base has a cylindrical configuration extending from the first end 24 toward the second end 26.

A hollow, cylindrical interior bore 28 extends into the base 14 from the base first end 24. A first portion of the bore 28 is surrounded by a cylindrical interior surface 32. The interior diameter of the cylindrical interior surface 32 is constant. As the interior bore extends toward the base second end, a second portion of the bore is formed with a necked-down portion having an interior surface 34 that has a smaller interior diameter dimension than the first portion of the bore. In the preferred embodiment, the interior diameter of the bore necked-down portion 34 is dimensioned to be just slightly larger than the diameter dimension of the end of a rod on which the apparatus is intended to be used. The cylindrical interior surfaces 32, 34 of the two portions of the interior bore 28 have a common center axis 36 that defines mutually perpendicular axial and radial directions relative to the apparatus 12.

As shown in the drawing figures, the base interior bore 28 extends axially through the base 14 from the base first end 24 and terminates at a circular end wall or end surface 38 of the bore 28. The end surface 38 completely covers over the distal end of the base interior bore 28.

The base 14 is also provided with a plurality of flexible fins 42 that extend axially along the interior surface 32 of the first portion of the interior bore 28. The fins 42 are similar in construction and function to fins employed in prior art rebar protective covers. However, it should be noted that the fins 42 of the base 14 are connected to only the interior surface 32 of the base bore 28 having the larger interior diameter. The fins 42 have projecting portions 44 that extend axially into the portion of the base bore 28 that is surrounded by the interior surface 34 having the smaller interior diameter. These fin projections 44, although extending into the portion of the bore surrounded by the smaller diameter interior surface 34, are not connected to the interior surface 34. This provides the fin projections 44 with greater flexibility than the remaining portions of the fins 42 connected to the large diameter interior surface 32. This greater flexibility of the fin projections 42 facilitates the removable attachment of the base 14 on the end of a rod with which the apparatus is used.

As the base 14 extends from the first end 24 toward the second end 26, the configuration of the base transforms from the cylindrical configuration adjacent the base first end 24 to a disk or cup-shaped configuration at the base second end 26. The cup-shaped configuration of the base second end 26 is surrounded by a circular rim 46 that extends completely around the outer perimeter of the base 14. Inside the rim 46 the base second end 26 is defined by a cup-shaped or concave second end surface 48. As shown in the drawing figures, the second end surface 48 is not a continuously curved concave or cup-shaped surface, but instead is defined by a plurality of concentric surface areas that together give the base second end surface 48 a generally concave shape. The surface areas include a substantially flat and circular central area 52 that is opposite the interior bore end surface 38, a first tapered annular portion 54 of the surface that surrounds the central area 52, a second substantially flat annular portion 56 of the surface that surrounds the first tapered portion 54, and a third annular tapered portion 58 of the surface that surrounds the second annular portion 56 and extends radially outwardly to the base rim 46. It should be understood that in alternate embodiments, the base second end surface 48 could have a continuously curved, concave configuration, could have a truncated cone configuration, could have a conical configuration, or could have other equivalent configurations to those described and shown in the drawing figures.

An annular groove 62 is recessed into the base second end surface 48. The groove 62 surrounds the central portion 52 of the end surface 48. The groove 62 has a cylindrical configuration and extends axially into the material of the base 14 at a position that is spaced radially outward from the portion of the bore interior surface 34 having the smaller diameter dimension. Thus, the groove 62 is positioned on the base 14 to be radially outside and surrounding the end of a rod or rebar inserted into the base 14 in use of the apparatus 12. In alternate embodiments of the apparatus, the groove 62 could have a configuration other than the cylindrical configuration shown and described. For example, the groove 62 could have the configuration of a truncated cone.

The exterior of the base is provided with a plurality of reinforcing ribs 64. The ribs are spaced circumferentially around the base 14 and extend axially across the base 14 between the cylindrical portion and the cup-shaped portion of the base 14. The ribs 64 are provided to resist movement of the base second end 26 away from the base center axis 36 in response to an impact force on the base second end 26 that is not substantially axially aligned with the base center axis 36.

The band 16 in the preferred embodiment is constructed of a metal material. Other equivalent materials may also be employed in the band construction. Also in the preferred embodiment, the band 16 has a cylindrical configuration with opposite interior 66 and exterior 68 surfaces. The band 16 has an axial length dimension and a width dimension that are complementary to the dimensions of the base annular groove 62 so that the band 16 can be securely mounted to the base 14 by insertion of the band in the groove 62. In alternate embodiments of the base groove 62, the configuration of the band 16 would be changed to be complementary to the configuration of the groove. With the band 16 inserted in the groove 62, the band 16 extends around the end of a rod inserted into the base interior bore 28. In assembling the band 16 to the base, it is not necessary that the base 14 be molded around the band 16. The band 16 can be separately assembled to the previously molded base, thereby simplifying the construction of the band 16 and the base 14.

The impact member 18 in the preferred embodiment is a circular plate or disk having a general cup-shaped configuration. In the preferred embodiment the impact member 18 is constructed of a metal material, although other equivalent materials may be employed. The impact member 18 has opposite first 72 and second 74 surfaces and a perimeter edge 76 that surrounds and separates the two surfaces 72, 74. The first surface 72 has a general convex configuration that is complementary to the general concave configuration of the base second end surface 48. Thus, in alternate embodiments of the base second end surface 48, the configuration of the impact member first surface 72 will be complementary to the configuration of the base second end surface 48. In the general cup-shaped configuration of the impact member 18 shown in the drawing figures, the second surface 74 defines the interior surface surrounding the interior volume of the cup-shaped configuration. The opposite first surface 72 defines the exterior surface of the cup-shaped configuration. In addition, the first surface 72 has a central portion 82 that is complementary to the central portion 52 of the base second end surface. The first surface 72 also has a first tapered annular portion 84 that is complementary to the first tapered annular portion 54 of the base second end surface 48, and has a second substantially flat annular portion 86 that is complementary to the second annular portion 56 of the base second end surface.

In further embodiments of the apparatus, the general perimeter configuration of the impact member 18 will match that of the base second end 26. For example, if the base second end 26 were to have a polygonal configuration at its perimeter, the complementary configuration of the impact member 18 would also be polygonal.

With the impact member 18 assembled in the apparatus 12, the impact member first surface 72 engages with the base second end surface 48. The impact member 18 overlays the band 16 assembled to the base 14, but is detached from the band. The separate assembly of the impact member 18 to the base 14 without requiring that the impact member 18 be molded and encapsulated in the base 14 further simplifies the construction of the apparatus.

The cap 22 is constructed of a material that is more resilient and more compressible and stretchable than the material of the base 14. In the preferred embodiment, the cap 22 is constructed of rubber, although other equivalent materials may be used. The cap 22 has a disk-shaped configuration with opposite first 92 and second 94 surfaces. The outer perimeter of the cap 22 is formed as a circular lip 96. The lip 96 extends between the cap first 92 and second 94 surfaces and projects axially from the cap first surface 92. The lip 96 is dimensioned to fit in a tight sealing fit overlaying the base rim 46.

A plurality of supporting ribs 98 are formed on the cap first surface 92. The ribs 98 extend radially outward from the center of the cap to a circular supporting wall 102 that also projects axially from the cap first surface 92. The circular wall 102 has an axial dimension that positions an end surface 104 of the wall in engagement against the impact member second surface 74 when the cap 22 is assembled to the base 14. In addition, each of the ribs 98 has an end surface 106 that is shaped complementary to the portion of the impact member second surface 74 that is engaged by the rib surface when the cap 22 is assembled to the base 14. This engagement of the cap ribs 98 and wall 102 against the impact member 18 securely holds the impact member 18 between the base 14 and cap 22. In addition, a plurality of webs 108 project axially from the cap first surface 92. The webs 108 are positioned radially outside the cap circular wall 102 and are dimensioned so that positioning surfaces 112 on the webs 108 will engage against the perimeter edge 76 of the impact member 18 when the base 14 is assembled to the cap 22. This securely holds the impact member 18 in its radial position relative to the base 14 and the cap 22.

The cap 22 is assembled to the base 14 following the assembly of the band 16 and the impact member 18 to the base 14. With the cap 22 assembled to the base, the cap lip 96 engages around the base rim 46. The lip 96 and rim 46 can be secured together by adhesives or other bonding agents. They could also be press fit together, RF welded together, or held together by any other equivalent means. In addition, in other embodiments of the apparatus, the band 16, the impact member 18, or both the band 16 and impact member 18 could be secured to the base 14 by being injection molded with the base prior to the cap 22 being secured to the base 14. In still further embodiments, the base 14 and cap 22 could be molded around both the band 16 and impact member 18. With the cap 22 secured to the base 14, the band 16 and impact member 18 are completely enclosed in the apparatus 12 and the cap second surface 74 forms an exterior surface of the apparatus. In addition, the open areas between the cap 22 and base 14 defined by the circular wall 102 and the radial ribs 108 and webs 108 on the cap first surface 92 function as air pockets that absorb and diminish an impact force on the cap second surface 94.

In use of the apparatus 12 positioned on the end of a rod, for example a concrete reinforcement rod, a force impacting on the apparatus 12 will initially compress the cap 22 and thereby be partially absorbed. The impact force will also be transmitted through the cap 22 to the impact member 18. A sufficiently large impacting force will cause the impact member 18 to deform from its cup-shaped configuration toward a planar configuration. In addition, the material of the cap 22 will continue to be compressed and spread across the impact member second surface 74. The combined deformation of the impact member 18 and the compression of the cap 22 distributes the impacting force over an increasing area of the apparatus 12 and thereby further absorbs the impacting force. The impact area of the apparatus 12 is at least the 16 square inch area required by OSHA standards.

In addition to the above, any impacting force on the apparatus 12 that is not generally axially aligned with the apparatus will have a tendency to move the apparatus 12 from its axial alignment with the end of the rod on which it is used. This tendency to move the apparatus 12 will be resisted by the band 16 mounted on the base 14 and positioned around the distal end of the reinforcing rod received in the base interior bore 28. The presence of the metal band 16 in the base 14 will resist the tendency of the end of the rod to tear through the material of the base 14 in response to a force impacting with the apparatus 12 that is not generally axially aligned with the apparatus.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A protective cover apparatus for attachment to an end of a rod to absorb impact energy from an object impacting the end of the rod, the apparatus comprising:

an impact member having opposite first and second surfaces, a perimeter edge that surrounds and separates the first and second surfaces, the impact member first surface having a convex configuration and the impact member second surface having a concave configuration;

a base having opposite first and second ends, the base first end being constructed to attach to the end of a rod and support the base on the end of a rod, and the base second end engaging with the impact member and supporting the impact member on the base with the impact member first surface facing towards the base second end and the impact member second surface facing away from the base;

a band having opposite interior and exterior surfaces, wherein the base second end engages with and supports the band with the band interior surface capable of surrounding the end of a rod received by the base first end and the band is positioned between the base and the impact member; and a cap having opposite first and second surfaces, the cap first surface engaging with the impact member second surface and the cap second surface being an exterior surface of the protective cover apparatus.

2. The apparatus of claim 1, further comprising:

a cap having opposite first and second surfaces, the cap first surface engaging with the impact member second surface and the cap second surface facing away from the base and the impact member.

3. The apparatus of claim 2, wherein:

the base and the cap completely enclose the impact member.

4. The apparatus of claim 1, wherein:

the impact member is a plate having a cup-shaped configuration.

5. The apparatus of claim 4, wherein:

the impact member is deformable from the cup-shaped configuration toward a planar configuration in response to an impact force on the apparatus that is directed toward the impact member second surface.

6. The apparatus of claim 1, wherein:

the impact member and the band are detached.

7. The apparatus of claim 1, wherein:

the impact member has a disk configuration of metal; and, the band has a cylindrical configuration of metal.

8. The apparatus of claim 1, wherein:

the base has a groove recessed into the base second end; and, the band is received inside the base groove.

9. The apparatus of claim 1, wherein:

the impact member has a disk configuration and is constructed of metal;

the base has a tubular configuration and is constructed of plastic;

the band has a cylindrical configuration and is constructed of metal; and, the cap has a disk configuration and is constructed of a resilient, compressible and stretchable material.

10. A protective cover apparatus for attachment to an end of a rod to absorb impact energy from an object impacting the end of the rod, the apparatus comprising:

an impact member having a cup-shaped configuration with opposite first and second surfaces and a perimeter edge that surrounds and separates the first and second surfaces, where the first surface defines an exterior surface of the cup-shaped configuration and the second surface defines an interior surface of the cup-shaped configuration, the second surface surrounding an interior volume of the cup-shaped configuration;

a base having opposite first and second ends, the base first end being constructed to attach to the end of a rod and support the base on the end of a rod, the base second end engaging with the impact member first surface and supporting the impact member on the base with the impact member first surface opposing the base second end and the impact member second surface facing away from the base, the base first end having an interior bore dimension which is dimensioned to receive the end of a rod;

a band mounted on the base, the band having opposite interior and exterior surfaces and the band interior surface extending around the base interior bore and the band is positioned between the base and the impact member; and a cap having opposite first and second surfaces, the cap first surface engaging with the impact member second surface and the cap second surface being an exterior surface of the apparatus.

11. The apparatus of claim 10, wherein:

the impact member is a metal material; and, the base is a plastic material.

12. The apparatus of claim 10, wherein:

the impact member first surface is a convex surface and the impact member second surface is a concave surface.

13. The apparatus of claim 10, wherein:

the impact member is deformable from the cup-shaped configuration toward a planar configuration in response to an impact force on the apparatus that is directed toward the impact member second surface.

14. The apparatus of claim 10, wherein:

the band is cylindrical and is a metal material.

15. The apparatus of claim 10, wherein:

the band and the impact member are detached.

16. The apparatus of claim 10, wherein:

the base has an annular groove recessed into the base second end and the band is received in the annular groove.

17. The apparatus of claim 10, wherein:

the impact member has a disk configuration and is constructed of a metal material;

the base first end has a cylindrical configuration and the base second end has a disk configuration, the base being constructed of a plastic material;

the band has a cylindrical configuration and is constructed of a metal material; and, the cap has a disk configuration and is constructed of a resilient, compressible and stretchable material.

* * * * *